US010494169B2

(12) United States Patent
Musolf et al.

(10) Patent No.: US 10,494,169 B2
(45) Date of Patent: Dec. 3, 2019

(54) PACKAGING FOR DIP TUBES

(71) Applicant: ENTEGRIS, INC., Billerica, MA (US)

(72) Inventors: Bruce Musolf, Eagan, MN (US); Carter W. Nelson, Delavan, WI (US)

(73) Assignee: ENTEGRIS, INC., Billerica, MA (US)

( * ) Notice: Subject to any disclaimer, the term of this patent is extended or adjusted under 35 U.S.C. 154(b) by 123 days.

(21) Appl. No.: 15/519,670

(22) PCT Filed: May 22, 2015

(86) PCT No.: PCT/US2015/032182
§ 371 (c)(1),
(2) Date: Apr. 17, 2017

(87) PCT Pub. No.: WO2016/060713
PCT Pub. Date: Apr. 21, 2016

(65) Prior Publication Data

US 2017/0253423 A1 Sep. 7, 2017

Related U.S. Application Data

(60) Provisional application No. 62/065,473, filed on Oct. 17, 2014.

(51) Int. Cl.
*B65D 85/20* (2006.01)
*B65D 27/08* (2006.01)
(Continued)

(52) U.S. Cl.
CPC ..... *B65D 85/20* (2013.01); *B65D 25/04* (2013.01); *B65D 27/08* (2013.01); *B65D 65/38* (2013.01);
(Continued)

(58) Field of Classification Search
CPC ..... B65D 27/08; B65D 65/38; B65D 75/20; B65D 75/28; B65D 75/30; B65D 75/323;
(Continued)

(56) References Cited

U.S. PATENT DOCUMENTS 1,703,139 A * 2/1929 Falcone ..... A63B 57/203 206/315.1
3,593,873 A 7/1971 Vonk
(Continued)

FOREIGN PATENT DOCUMENTS

CN 101272861 A 9/2008
CN 201284077 Y 8/2009
(Continued)

OTHER PUBLICATIONS https://www.amazon.com/White-Dispenser-Collars-Lotion-Bottles/dp/B01IE8HSOA/ref=sr_1_cc_1?s=aps&ie=UTF8&qid=1541789841&sr=1-1-catcorr&keywords=white+dispenser+pumps+and+collars+for+soap+and+lotion+jars+or+bottles&refinements=p_n_srvg_2947266011%3A2972996011 (Year: 2013).*
(Continued)

*Primary Examiner* — Mollie Impink
(74) *Attorney, Agent, or Firm* — Entegris, Inc.

(57) ABSTRACT

A packaging pouch for storing and/or transporting one or more dip tube assemblies is provided. The pouch includes a front side sealably and fixedly attached to a back side along a first sealed edge, a second sealed edge, and a sealed end. The front side and back side define an opening at an end opposite the sealed end. A plurality of welds extend over at least a portion of the length of the pouch from the sealed end towards the opening, wherein generally adjacent welds define cavities for dip tube storage. Individual dip tubes are held separated and out of contact with each other within individual cavities, reducing or preventing generation of particulates or other contaminants. The packaging pouch is sealed to provide additional protection. Related packaging systems and methods are also disclosed.

8 Claims, 5 Drawing Sheets

(51) Int. Cl.

| | |
|---|---|
| ***B65D 65/38*** | (2006.01) |
| ***B65D 75/58*** | (2006.01) |
| ***B65D 85/08*** | (2006.01) |
| ***B65D 25/04*** | (2006.01) |
| *B65D 83/02* | (2006.01) |

(52) U.S. Cl.
CPC ..... *B65D 75/5805* (2013.01); *B65D 85/08* (2013.01); *B65D 83/02* (2013.01)

(58) Field of Classification Search
CPC .. B65D 75/327; B65D 75/324; B65D 75/328; B65D 75/326; B65D 75/5827; B65D 75/5855; B65D 77/08; B65D 81/2061; B65D 83/02; B65D 85/20; B65D 85/24; B65D 85/28; A61B 2050/3008
See application file for complete search history.

(56) References Cited

U.S. PATENT DOCUMENTS

| | | | | |
|---|---|---|---|---|
| 3,808,414 | A * | 4/1974 | Roberts | B65D 81/3266 362/34 |
| RE31,076 | E * | 11/1982 | Herman | B65D 85/109 206/246 |
| 4,421,231 | A | 12/1983 | McCarn | |
| 4,433,783 | A * | 2/1984 | Dickinson | B65D 77/08 206/484 |
| 4,512,472 | A | 4/1985 | Jarund | |
| 4,778,053 | A | 10/1988 | Hakansson | |
| 5,226,530 | A * | 7/1993 | Golden | A61M 25/002 206/210 |
| 5,518,151 | A * | 5/1996 | Knickerbocker | B05B 15/30 222/382 |
| 7,335,721 | B2 | 2/2008 | Alberg | |
| 8,313,821 | B2 | 11/2012 | Yan et al. | |
| 2001/0001443 | A1 | 5/2001 | Kayerod et al. | |
| 2006/0239594 | A1* | 10/2006 | Ishizaki | B65D 31/12 383/63 |
| 2007/0221527 | A1 | 9/2007 | Wojcik | |
| 2008/0063325 | A1* | 3/2008 | Miller | B65D 75/20 383/211 |
| 2009/0212071 | A1 | 8/2009 | Tom et al. | |
| 2010/0112815 | A1 | 5/2010 | O'Dougherty et al. | |
| 2011/0187028 | A1 | 8/2011 | Menning et al. | |
| 2011/0226806 | A1 | 9/2011 | O'Dougherty et al. | |
| 2013/0074923 | A1 | 3/2013 | Jung et al. | |
| 2013/0193164 | A1 | 8/2013 | Tom et al. | |
| 2013/0279832 | A1* | 10/2013 | Burri | B65D 75/5855 383/205 |
| 2013/0284766 | A1 | 10/2013 | Dubois et al. | |
| 2015/0353237 | A1* | 12/2015 | Haedt | B65D 75/5805 383/207 |

FOREIGN PATENT DOCUMENTS

| | | | | |
|---|---|---|---|---|
| CN | 102991815 | A | 3/2013 | |
| DE | 9 301 892 | U1 | 4/1993 | |
| EP | 0 043 030 | B1 | 8/1985 | |
| GB | 1246415 | A * | 9/1971 | B65D 27/08 |
| JP | 0349947 | U | 5/1991 | |
| JP | 2010-208690 | A | 9/2010 | |
| KR | 10-0973707 | B1 | 8/2010 | |
| TW | 264383 | B | 12/1995 | |
| TW | 1391301 | B | 4/2013 | |
| WO | 2008/029332 | A2 | 3/2008 | |
| WO | 2009/076101 | A1 | 6/2009 | |
| WO | 2011/006146 | A2 | 1/2011 | |
| WO | 2011/046802 | A2 | 4/2011 | |
| WO | 2012/071376 | A2 | 5/2012 | |
| WO | 2012/118527 | A1 | 9/2012 | |
| WO | 2013/096579 | A1 | 6/2013 | |
| WO | 2014/070877 | A1 | 5/2014 | |
| WO | 2014070877 | A1 | 5/2014 | |
| WO | 2016/060713 | A1 | 4/2016 | |

OTHER PUBLICATIONS

Pfister, Jun. 3, 2013, found on Amazon, https://www.amazon.com/Pfister-S310020-Soap-Dispenser-Pump/dp/B00D5Z7X3E/ref=pd_rhf_se_p_img_7?_encoding=UTF8&psc=1&refRID=YZ3MDBVV3TH4NP8CYSF0 (Year: 2013).*

* cited by examiner

PACKAGING FOR DIP TUBES

CROSS-REFERENCE TO RELATED APPLICATION

This application is related to and claims the benefit of commonly owned U.S. Provisional Patent Application No. 62/065,473, filed Oct. 17, 2014, which is incorporated herein by reference for all purposes.

BACKGROUND

Container systems are used in many industries for storing, shipping and dispensing materials. Typically, a shipping and dispensing container system includes a container, an optional liner, and a cap used to seal and protect the contents of the system when the contents are not being dispensed. The system includes a fitment that allows caps, connectors, or other coupling devices to be coupled with the container system for dispensing the contents of the container Some systems further include a dip tube or a dip tube assembly that may assist in dispensing the contents.

Conventional dip tube assemblies include a relatively long and slender tubular portion that is generally cylindrically shaped, and that has a given diameter and length depending on the intended use. The tubular portion is configured for placement so as to extend into an interior cavity of the container and/or liner. To assist in proper placement of the tubular portion, the tubular portion is configured to cooperate with a coupler portion that is shaped and configured to substantially fit the mouth of the container/liner, such as by fitting into a fitment portion thereof. The tubular portion is thus fixedly coupled with the container/liner.

Dip tube assemblies typically are stored and/or shipped in a single bag or packaging, without restraint between the individual dip tube assemblies. As a result, the dip tube assemblies are permitted to move around during storage and shipping and repeatedly come into contact with one another, potentially generating particulates within the bag or packaging. Such particulates can contact and adhere to the dip tube assemblies, reducing the quality of the dip tube assemblies and potentially adversely affecting the contents of the container/liner with which the dip tube assemblies ultimately are used. Additionally, such placement in a bag or packaging without restraint can reduce the straightness of the dip tube assemblies or otherwise cause damage.

SUMMARY

The present disclosure relates to packaging for dip tubes and/or dip tube assemblies, and methods for manufacturing the same. Embodiments of the disclosure individually restrain individual dip tubes or dip tube assemblies within the packaging, for reduced particulate generation and reduced damage to the dip tubes and dip tube assemblies. Dip tube assemblies include a dip tube attached to a coupler or coupler portion, according to embodiments of the disclosure.

In one embodiment, the present disclosure relates to a packaging pouch for storing and/or transporting one or more dip tube assemblies. The pouch includes a front side sealably and fixedly attached to a back side along a first sealed edge, a second sealed edge, and a sealed end. The front side and back side define an opening at an end opposite the sealed end. A plurality of welds extend over at least a portion of the length of the pouch from the sealed end towards the opening, wherein generally adjacent welds define cavities for dip tube storage. The pouch is formed of one or two sheets of polyethylene, for example a single blown tube of polyethylene film, or two substantially rectangular sheets of polyethylene, each sheet of polyethylene being in the range of 3 mils to 6 mils thick or being about 4 mils thick. The pouch is substantially transparent or translucent, according to embodiments of the disclosure, which allows an end user to see dip tube assemblies or other items shipped or stored within.

According to various embodiments of the disclosure, a packaging pouch is adapted to hold one or more dip tube assemblies. The pouch includes a front side sealably and fixedly attached to a back side along a first sealed edge, along a second sealed edge and along a sealed end, the front side and back side defining an opening at an end of the pouch opposite the sealed end. A plurality of welds extend over a portion of the length of the pouch from the sealed end towards the opening, and a first weld of the plurality of welds and a second, next-most-adjacent weld of the plurality of welds define a cavity adapted to hold a dip tube assembly. The plurality of welds are shorter in length than the pouch, shorter in length than the first sealed edge, and shorter in length than the second sealed edge to define a pocket at the end of the pouch opposite the sealed end. The cavity opens into the pocket. The pocket is wider than the cavity between the first sealed edge and the second sealed edge to accommodate a widened portion of the dip tube assembly extending from the cavity. In some cases, the plurality of welds define a plurality of cavities adapted to hold a plurality of dip tube assemblies, the plurality of cavities opening into the pocket. The pocket is wider than the plurality of cavities between the first sealed edge and the second sealed edge to accommodate widened portions of the dip tube assemblies extending from the cavities, and the cavities are adapted to individually hold the dip tube assemblies out of contact with each other.

In some embodiments, the packaging pouch also includes a compartment weld extending along a length of the pouch from the sealed end towards the opening, to divide the pouch into first and second compartments. The plurality of welds defining the plurality of cavities are a plurality of cavity welds, the compartment weld is longer than each of the cavity welds, and the plurality of cavity welds are disposed on opposite sides of the compartment weld to define a plurality of cavities in the first compartment and a plurality of cavities in the second compartment. The compartment weld stops short of the opening at the end of the pouch opposite the sealed end. The pocket is a first pocket in the first compartment and the pouch further comprises a second pocket in the second compartment on an opposite side of the compartment weld from the first pocket, the cavities in the first compartment opening into the first pocket, and the cavities in the second compartment opening into the second pocket.

The packaging pouch can also include a seal extending transversely across a width of the pouch to seal the pouch near the open end, the seal extending across the compartment weld. A tear strip is disposed at the open end for opening the pouch and removing dip tube assemblies from the pouch. In some cases, tear notches provided at the first and second sealed edges, disposed between the seal and the cavities, define the tear strip.

In some embodiments, the pouch can include a heat seal extending transversely across a width of the pouch to seal the pouch near the open end.

According to additional embodiments of the disclosure, a dip tube assembly packaging system includes a plurality of dip tube assemblies, each dip tube assembly comprising a tube and a coupler attached to the tube, the coupler being wider than the tube. The packaging system additionally includes a package including at least one flexible sheet of polymeric material, the package defining sealed edges and a sealed end extending between the sealed edges. The package further defines a plurality of separated internal cavities, at least the tube of each dip tube assembly being disposed in a respective cavity. At least one pocket is disposed at an end of the package opposite the sealed end, the plurality of separated internal cavities adjoining the pocket, the couplers of the dip tube assemblies extending with respect to the respective cavities into the pocket such that the couplers are disposed within the pocket. The package maintains the dip tube assemblies, especially the tubes of the dip tube assemblies, separated and out of contact with each other, to avoid particulate generation caused by contact between the tubes.

According to embodiments of the disclosure, the package defines a compartment divider that divides the package into two compartments, and the at least one pocket includes a plurality of pockets, each compartment containing a plurality of the separated internal cavities and each compartment including a respective pocket of the plurality of pockets. A first group of the dip tube assemblies is disposed in the cavities of the first compartment and a second group of the dip tube assemblies is disposed in the cavities of the second compartment.

A seal optionally extends across the package to seal the first compartment from the second compartment and to seal the first and second compartments from the outside of the package. A tear notch is disposed on a side of the package, the tear notch adapted to create a tear strip across the first compartment from the side of the package to the compartment divider, to open the first compartment and allow removal of the dip tube assemblies from the first compartment while the second compartment remains sealed. The tear notch is optionally a first tear notch on a first side of the package and is adapted to create a first tear strip, and the package further includes a second tear notch disposed on a second side of the package opposite to the first side, the second tear notch adapted to create a second tear strip across the second compartment from the second side of the package to the compartment divider, to open the second compartment and allow removal of the dip tube assemblies from the second compartment.

The package is optionally at least twice as long as each dip tube assembly, and optionally is one-piece including a single sheet of polymeric material, the plurality of separated internal cavities being defined by at least one seal extending along a length of the package. The package also optionally includes two sheets of polymeric material sealed together along the side edges and the sealed end.

A method of making a dip tube assembly packaging system includes providing a package including at least one sheet of flexible polymeric material having sealed edges and a first sealed end extending between the sealed edges. The method further includes providing at least one seal extending between and substantially parallel to the sealed edges to create a plurality of separated internal cavities between the sealed edges, the separated internal cavities each having a length that is less than a length of the at least one sheet. The method further includes inserting a respective dip tube assembly into each internal cavity, each dip tube assembly including a dip tube and a coupler connected to the dip tube, such that the dip tube of each dip tube assembly is disposed within a respective cavity and held out-of-contact with an adjacent dip tube, and such that the coupler of each dip tube assembly extends within the package from the respective cavity. The method also includes sealing an end of the package opposite the first sealed end to create a second sealed end and seal the package, the dip tube assemblies being sealed within the package.

According to embodiments of the disclosure, each internal cavity has an occupied portion in which a respective dip tube is disposed, and an empty portion extending from the occupied portion toward the first sealed end. The method further includes folding the package over onto itself such that the empty portion of each cavity lies over or under the occupied portion of each cavity.

The method also optionally includes providing a compartment seal extending between and substantially parallel to the sealed edges and the at least one seal, the compartment seal dividing the package into two compartments each having a plurality of the internal cavities and a plurality of the dip tube assemblies. Embodiments of the disclosure also include providing at least one tear notch at at least one of the sealed edges of the package, to create a tear strip extending from the at least one sealed edge to the compartment seal and facilitate opening of the package for removal of the dip tube assemblies. The method also optionally includes vacuum sealing the package.

Methods of making the package for the dip tube assemblies also are provided and optionally are incorporated in the method of making a dip tube assembly packaging system described herein. One such method includes providing a single sheet or two sheets of sheet material, providing the sheet or sheets with sealed edges and a sealed end to form a pouch, providing cavities within the pouch, the cavities being adapted to accommodate dip tubes or other elongated optionally thin and cylindrical objects; and optionally providing a compartment weld extending along the pouch to create two separate compartments, each including one or more of the cavities. Additionally, it will be apparent that embodiments of the disclosure are applicable to packaging and methods for other items, especially items having an elongated and/or cylindrical shape, not just dip tube assemblies.

Still other embodiments of the present disclosure will become apparent to those skilled in the art from the following detailed description, which shows and describes illustrative embodiments of the disclosure. As will be realized, embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

Embodiments of the disclosure are described with respect to the figures, in which like reference numerals denote like elements and in which.

DETAILED DESCRIPTION

Figure 1:
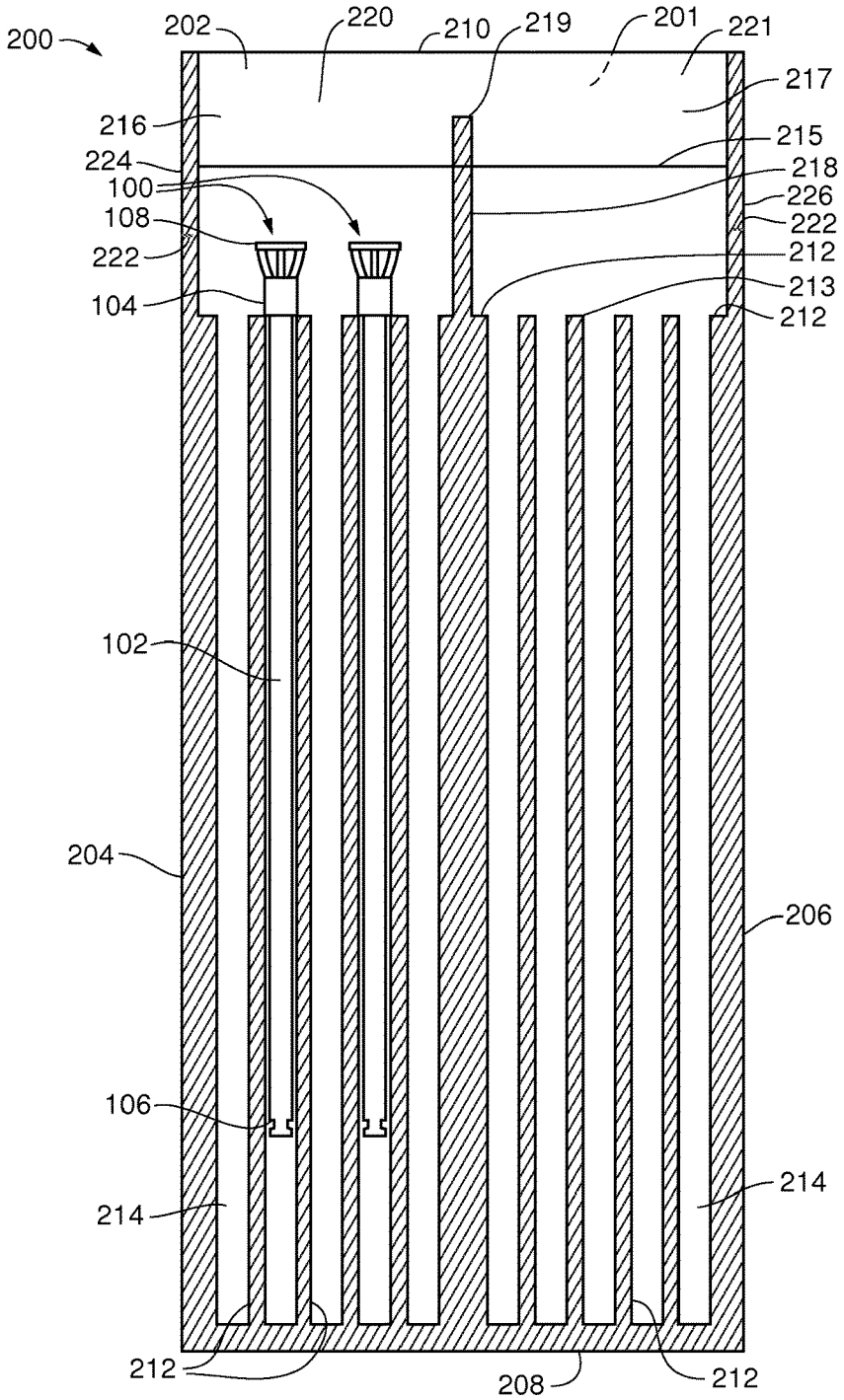
FIG. 1 is a front view of a dip tube assembly and packaging pouch, according to an embodiment of the disclosure.

The present disclosure relates to packaging for items such as dip tube assemblies, and methods for manufacturing and using such packaging. According to embodiments of the disclosure, dip tube assemblies are individually restrained within the packaging for reduced particulate generation, better ability to maintain the shape of dip tube assemblies, reduced damage to the dip tube assemblies, and other advantages.

Dip tube assemblies referenced herein include a coupler portion having a receiving cavity that has a generally circular opening and a diameter cross-section that slightly tapers or narrows moving further into the receiving cavity, away from the entrance thereof, so as to form a conical frustum. The tubular portion of the dip tube assembly may be inserted into the opening of the conical frustum shaped receiving cavity of the coupler in friction-fit or press-fit style, thereby snuggly holding the tubular portion in generally fixed attachment with the coupler portion for sealability. Other dip tube assemblies include a coupler portion that is configured at one end for insertion into a top end of the tubular portion, in somewhat reverse fashion. To insert the end of the coupler portion into the top end of the tubular portion, the top end of the tubular portion is first heated on a mandrel to widen the opening, thereby permitting insertion of the coupler end. When cooled, the coupler and tubular portion are thereby coupled via interference fit.

In some embodiments, dip tube assemblies are used with existing container and/or dispensing systems, while in other embodiments, dip tube assemblies are specifically configured for compatibility with a custom container and dispensing system. Examples and embodiments of the type of liners, dip tube assemblies, dip tubes, couplers, overpacks, and connectors that can be utilized in generally the same industries as the dip tube packaging of the present disclosure are disclosed in more detail in: PCT Pub. No. WO/2014/070877; U.S. Pat. Pub. No. 2013/193164; PCT Pub. No. WO/2012/118527; PCT Pub. No. WO/2013/096579; U.S. Pat. Pub. No. 2013/284766; PCT Pub. No. WO/2012/071376; U.S. Pat. Pub. No. 2011/226806; U.S. Pat. Pub. No. 2010/112815; PCT Pub. No. WO/2011/046802; PCT Pub. No. WO/2011/006146; U.S. Pat. No. 7,335,721; U.S. Pat. Pub. No. 2009/212071; U.S. Pat. No. 8,313,821; U.S. Pat. Pub. No. 2011/187028; PCT Pub. No. WO/2009/076101; and PCT Pub. No. 2013/074923, all of which are hereby incorporated by reference herein in their entireties for all purposes.

The various embodiments of dip tube assemblies contemplated herein can be used with any suitable dispense process, including direct and indirect pressure dispense, pump dispense, and pressure-assisted pump dispense, as well as various embodiments of inverted dispense methods disclosed in e.g. Korean patent registration No. 10-0973707, titled "Apparatus for Supplying Fluid," which is hereby incorporated by reference herein in its entirety.

Any of the dip tube assemblies, or the various components thereof, such as the tubular portion, coupler portion, or any other additional components, can be manufactured using any suitable manufacturing process, such as, but not limited to, injection molding, injection blow molding, injection stretch blow molding, extrusion, etc. In some embodiments, the tubular portion and coupler portion can be manufactured separately, as separate components, while in other embodiments, they can be manufactured as a single, unitary component. Likewise, the tubular portion and/or coupler portion can each separately be formed of a single unitary element, or they can each be formed of a combination of multiple elements.

Any of the dip tube assemblies of the present disclosure, or the various components thereof, can be formed of any suitable material or combination of materials, for example but not limited to, one or more polymers, including plastics, nylons, EVOH, polyesters, polyolefins, or other natural or synthetic polymers. In further embodiments, any of the dip tube assemblies of the present disclosure, or the various components thereof, can be manufactured using polyethylene terephthalate (PET), polyethylene naphthalate (PEN), poly(butylene 2,6-naphthalate) (PBN), polyethylene (PE), linear low-density polyethylene (LLDPE), low-density polyethylene (LDPE), medium-density polyethylene (MDPE), high-density polyethylene (HDPE), polypropylene (PP), and/or a fluoropolymer, such as but not limited to, polychlorotrifluoroethylene (PCTFE), polytetrafluoroethylene (PTFE), fluorinated ethylene propylene (FEP), and perfluoroalkoxy (PFA). Any portion of a dip tube assembly can be formed of the same or different material(s) than one or more other portions of the dip tube assembly.

After dispense is completed or substantially completed and the liner is empty or substantially empty, the end-user can dispose of the dip tube assembly and/or recycle some or all components of the dip tube assembly. To assist in making a dip tube assembly described herein more sustainable, the dip tube assembly or one or more components thereof, in some embodiments can be manufactured from biodegradable materials or biodegradable polymers, including but not limited to: polyhydroxyalkanoates (PHAs), like poly-3-hydroxybutyrate (PHB), polyhydroxyvalerate (PHV), and polyhydroxyhexanoate (PHH); polylactic acid (PLA); polybutylene succinate (PBS); polycaprolactone (PCL); polyanhydrides; polyvinyl alcohol; starch derivatives; cellulose esters, like cellulose acetate and nitrocellulose and their derivatives (celluloid); etc. Similarly, in some embodiments, and if suitable for the industry application, a dip tube assembly, or one or more components thereof, can be manufactured from materials that can be recycled or recovered, and in some embodiments, used in another process by the same or a different end user, thereby allowing such end user(s) to lessen their impact on the environment or lower their overall emissions. For example, in one embodiment, the dip tube assembly or one or more components thereof can be manufactured from materials that can be incinerated, such that the heat generated therefrom can be captured and incorporated or used in another process by the same or different end user. In general the dip tube assembly or one or more components thereof can be manufactured from materials that can be recycled, or that can be converted into raw materials that can be used again.

Packaging bag or pouch embodiments contemplated according to embodiments of the disclosure can include one or more sheets. Each sheet can include one or more of the aforementioned materials. Further, the sheet or sheets can include a single sheet of one or more materials (blends or coextruded layers), or one or more sheets combined along at least a portion thereof by methods including welds, adhesives, laminates, heat sealing, and combinations thereof.

FIG. 1 shows dip tube assembly 100 within or as a part of a dip tube packaging system according to an embodiment of the disclosure. Dip tube assembly 100 includes tubular portion or dip tube 102 and coupler or coupler portion 104. Tubular portion 102 is generally cylindrically shaped or straw-like with an interior passageway extending generally from one end to the other, as will be understood by those skilled in the art upon reading this disclosure. Tubular portion 102 is substantially long and slender, as illustrated; however, it is understood that tubular portion 102 can have any suitable or desirable length and any suitable or desirable exterior diameter as well as interior passageway diameter. For example, the length and diameter of the tubular portion can depend on the intended application and desired dispense characteristics. In some embodiments, a bottom end, or an end opposite the location of coupler portion 104, can include one or more side wall openings 106. Side wall openings 106 can provide improved dispensing of liquid or other material through the dip tube via tubular portion 102. Side wall openings 106 can be in the form of cross ports, for example, allowing fluid to enter dip tube 102 when the bottom of dip tube 102 is against a liner or container bottom, so that flow is not inhibited by the liner or container.

Coupler portion 104 is coupled with or integral with tubular portion 102. Coupler portion 104 can take on various configurations, but is generally configured at one end to cooperate in fluid communication with a top end of tubular portion 102 and at the other end to substantially fit into, or adjacent to, the mouth of a particular liner or other container, such as by fitting into or adjacent to, or otherwise coupling with, a fitment portion of the liner or container. In this regard, coupler portion 104 can be configured to cooperate, or fit, with any suitable liner or container, thus permitting flexible use of tubular portion 102 with any particular model container or other custom container. Some coupler portions 104 include O-ring 108 at the upper end thereof.

Coupler portion 104 generally assists in the proper placement of tubular portion 102 and generally maintains the tubular portion in fixed relationship with the liner or container during dispense of the contents therein. Coupler portion 104 also includes an interior passageway extending generally from one end to the other. The interior passageway is in fluid communication with the interior passageway of the tubular portion such that a fluid or other material can flow from a bottom end of the tubular portion, through the tubular portion and the coupler so as to exit at a top end of the coupler such as, for example, during delivery to a dispense connector and subsequent downstream process. As will also be appreciated by those skilled in the art, dip tube assemblies, such as dip tube assembly 100, can be used with any suitable container and/or dispensing system.

One embodiment of packaging container, bag or pouch 200 is also depicted in FIG. 1. Packaging pouch 200 includes a flexible, low-density sheet material, according to embodiments of the disclosure, such as polynylon, polyethylene, or another relatively thin polymer or plastic material that attracts and/or or creates a relatively low number of particles. In other embodiments, packaging pouch 200 includes one or more of the materials identified within this application, or incorporated into this application, as suitable for a dip tube assembly, liner or overpack of a container system. Embodiments of such materials include flexible materials, for example capable of readily bending or changing shape in the manner of a plastic bag, and substantially inflexible or substantially rigid materials, which are not as readily bendable or changeable in shape, e.g. generally stiff, unyielding or not pliant when used to form packaging container or pouch 200. In one embodiment, packaging pouch 200 includes thin flexible back sheet or side 201 and a relatively similar front sheet or side 202. In one non-limiting example, the thicknesses of front sheet 202 and/or back sheet 201 are, each in the range of about 1 mil to about 15 mils inclusive, where a "mil" is 0.001 inches. In another non-limiting example, the thicknesses of front and/or back sheets 202, 201 are each in the range of about 3 mils to about 6 mils inclusive, or each are about 4 mils. According to embodiments of the disclosure, the thickness of sheets 202 and/or 201 is chosen to facilitate easy creation of a seal and/or weld of the resulting pouch 200.

Front side 202 is sealably and fixedly attached to back side 201 along first sealed edge 204, second sealed edge 206, and sealed end 208. Sealed edges 204, 206 and sealed end 208 are formed by welds or adhesives, according to embodiments of the disclosure. In some embodiments, front side 202 is integrally formed with back side 201, for example in the form of a tube of material, and one or more of edges 204, 206 and end 208 can be defined a fold line or fold region that provides sealing at the edges or end, with or without additional heat sealing or welding. Packaging pouch 200 has open end or opening 210 at an end opposite sealed end 208, providing access to the interior of the pouch.

Packaging pouch 200 further includes a plurality of cavity-defining seals or welds 212 that extend over a portion of the length of the pouch from sealed end 208 toward opening 210. In one embodiment, each weld 212 begins at sealed end 208 and has end 213 between sealed end 208 and opening 210. In one embodiment, one weld 212 is immediately adjacent to first sealed edge 204, and another weld 212 is immediately adjacent to second sealed edge 206. However, such welds immediately adjacent first sealed edge 204 and second sealed edge 206 are not required, and, for example, first sealed edge 204 and/or second sealed edge 206 can doubly act as a cavity-defining weld.

Welds 212 (or sealed edges 204, 206) and sealed end 208 define cavities 214 such that dip tube assemblies 100 are inserted through opening 210 and, one each, into cavities 214 for storage and/or transportation, while remaining individually separated from adjacent dip tube assemblies. Ends 213 of cavity welds 212 stop short of opening 210, and thus cavity welds 212 are shorter in length than pouch 200, first sealed edge 204, and second sealed edge 206. Pouch 200 thus defines pockets 216, 217 between cavities 214 and opening 210. Cavities 214 open into pockets 216, 217. Each pocket 216, 217 is substantially wider than each cavity 214 and accommodates one or more couplers 104 of one or more dip tube assemblies 100. As viewed in FIG. 1, pocket 216 is a left pocket and pocket 217 is a right pocket.

As shown in e.g. FIG. 1, each coupler 104 extends from a respective cavity 214 into one of pockets 216, 217, instead of being accommodated within cavity 214. Holding coupler 104 outside each cavity 214 provides several advantages, including easier manual or other removal of dip tube assemblies from pouch 200, and reduced possibility that dip tubes 102 will penetrate the bottom of each cavity 214 e.g. at or through end seal 208. Each coupler 104 is attached to a respective dip tube 102 disposed within a respective cavity 214, and couplers 104 are held spaced from and out of contact with each other. At the same time, dip tubes 102 attached to couplers 104 are individually held in respective cavities 214, separated and out of contact with each other by cavity welds 212 between them. Dip tube assemblies 100 as a whole thus are held separated and out of contact with each other, even though cavity welds 212 do not necessarily extend between couplers 104. Embodiments of the disclosure thus provide that adjacent dip tube assemblies 100, or at least significant portions thereof including dip tubes 102, are substantially prevented from directly contacting each other. Isolating the dip tubes or dip tube assemblies from one another in this manner, and retaining the dip tube assemblies in place, as shown, reduces or prevents generation of contaminating particulates during transportation and/or storage. Manufacturing and transport of pouch 200, as well as filling and emptying dip tube assemblies 100 of pouch 200, all occur in a clean-room or other clean environment.

Embodiments of the disclosure provide a relatively snug fit for each dip tube 102 within its respective cavity 214, to securely hold each dip tube in a light interference fit arrangement. Coupler 104 is substantially prevented from entering cavity 214 due to its greater width relative to dip tube 102 and the cavity. Dip tube 102 thus is generally prevented from dropping or migrating to the bottom of cavity 214 and/or piercing sealed end 208. Additionally, in at least one embodiment, cavities 214 are parallel to one another, and thus when stored within packaging pouch 200, dip tubes 102 are similarly aligned parallel with one another and held in a straight configuration, thereby also reducing the possibility of damage to assemblies 100 and especially to dip tubes 102. Of course, pouches and systems according to embodiment of the disclosure also can be used to hold dip tubes 102 alone, without associated couplers 104.

The various welds and seals described throughout this disclosure, for example welds 212, 218, sealed edges 204, 206, and sealed end 208, can be formed by a heat-welding or heat-fusion process. In one embodiment, a platen having raised faces that define the pattern of the welds 212, 218 and sealed edges/end 204, 206, 208 is heated to a point where application to sheets 202 and 201 will cause the sheet material to melt and flow or bond together, thus fusing sheets 202 and 201 together, thereby creating the welds 212, 218 and sealed edges/ends 204, 206, 208 without the addition of extra pieces or parts to sheets 201 or 202.

In some embodiments, a plurality of dip tube assemblies are simultaneously stored within a single packaging pouch 200. In the embodiment shown in FIG. 1, packaging pouch 200 has ten cavities 214 to allow for the storage of up to ten dip tube assemblies within the packaging pouch. However, it is contemplated by the present disclosure that a greater number of lesser number cavities can be provided in a particular packaging pouch. In one embodiment, when in a stored position in the packaging pouch, generally only the tubular portion, or a subportion thereof, of a dip tube assembly, such as but not limited to dip tube assembly 100, extends into cavity 214. In other embodiments, however, the entire dip tube assembly can be stored within cavity 214, such that the entire dip tube assembly is positioned between end 213 of weld 212 and sealed end 208. In other embodiments, only dip tubes 102, without associated couplers 104, are stored within cavities 214.

In some embodiments, once dip tube assemblies are inserted into packaging pouch 200, opening 210 or other portion of pouch 200 is sealed. Opening 210 can be sealed by any suitable method, including but not limited to adhesives, welds, heat sealing, and the like. As shown in FIG. 1, seal 215 is displaced from opening 210 instead of being disposed precisely at opening 210. In still further embodiments, a vacuum is applied to packaging pouch 200 to reduce or eliminate any air or other particulates prior to opening 210 being sealed. Sealing pouch 200 protects the interior of pouch 200 from outside contaminants.

A single packaging pouch design/configuration can be suitable for receiving and storing dip tube assemblies of various lengths. In some embodiments, a single packaging pouch 200 can receive and store a plurality of dip tube assemblies, all of the same shape and length. In other embodiments, however, a single packaging pouch 200 can receive and store a plurality of dip tube assemblies, where at least some of the dip tube assemblies have different shapes and/or lengths. In some embodiments, a dip tube assembly, and more particularly the tubular portion of the dip tube assembly, can be shorter than the length of cavity 214. To better accommodate such dip tube assemblies, packaging pouch 200 is optionally configured to permit folding along a line or region generally perpendicular to the length of the packaging pouch and parallel to sealed end 208 such that sealed end 208 overlaps a portion of one of front side 202 and back side 201 of the packaging pouch, thereby effectively reducing the overall length of the usable space of the packaging pouch. Folding packaging pouch 200 in this manner also can ease the packaging of shorter dip tube assembly embodiments into packing bags, cartons and/or other secondary packaging for transportation and storage, and can further allow flexibility in using the same packaging pouch design/configuration for various shaped and sized dip tube assemblies.

As shown in FIG. 1, packaging pouch 200 additionally includes at least one compartment weld 218 that defines compartments 220, 221, extending lengthwise along pouch 200 and each having multiple cavities 214. Although only one compartment weld 218 defining two compartments 220, 221 are illustrated, embodiments of the disclosure contemplate having two, three, or more compartment welds 218, defining three, four, or more compartments. Compartment weld 218 runs parallel to first sealed edge 204 and second sealed edge 206 in the illustrated embodiment. Compartment weld 218 can lie between, and immediately adjacent to, two cavity welds 212. Alternatively, compartment weld 218 can also take on the double role of a cavity-defining weld. In one embodiment, compartment weld 218 extends from sealed end 208 toward opening 210 along the length of packaging pouch 200. Each weld 218 begins at sealed end 208 and has end 219 between sealed end 208 and opening 210. According to embodiments of the disclosure, compartment weld 218 is longer than each cavity-defining weld 212. In the embodiment shown in FIG. 1, packaging pouch 200 is divided into two compartments 220, 221 of five cavities 214 each. As shown in FIG. 1, a first compartment 220 is defined between first sealed edge 204 and compartment weld 218, and second compartment 221 is defined between second sealed edge 206 and compartment weld 218.

Of course, FIG. 1 illustrates only one example, and packaging pouches according to embodiments of the disclosure can include a greater number or lesser number of compartments than illustrated; likewise each compartment can contain a greater number or lesser number of cavities than that illustrated. A plurality of dip tube assemblies 100 are stored in or held by cavities 214 within each compartment. In some embodiments, the compartmented sections, e.g., 220, 221, are each individually opened for access to just those dip tube assemblies 100 in the opened compartment. A user can open a given compartment by any suitable manner. For example, in one embodiment, a user opens a compartment of packaging pouch 200 by cutting, tearing, etc. the end of pouch 200 near the opening of that compartment.

In some embodiments, one or more tear notches 222 form one or more tear-off strips 224, 226, extending generally perpendicularly to the length of pouch 200, for example from sealed edge 204 and/or 206 to compartment weld 218, for assisting or permitting easy opening of the packaging pouch near a compartment, allowing a user to access a single compartment at a time. For instance, when tear-off strip 224 is opened, a user can access dip tube assemblies 100 stored in cavities 214 of first compartment 220, while leaving the other dip tube assemblies 100 stored in second compartment 221 sealed, clean and free of contaminants. Where more than two compartments are provided, tear-off strips can likewise extend between corresponding intervening compartment welds 218. Alternatively, instead of extending generally perpendicularly across pouch 200, one or more alternative tear-off strips can extend any distance lengthwise along packaging pouch 200 along one or both sealed edges 204, 206, e.g. from opening 210 to or toward end 213 of each cavity weld 212. In the illustrated embodiment, each tear notch 222 extends as a slit a portion of the way through edge seal 204, 206, allowing a user of pouch 200 to easily begin creating one or more tear-off strips 224, 226 and opening pouch 200. Additional details regarding tear notches 222 and associated tear-off strips are illustrated and described with respect to FIGS. 5-6.

After inserting dip tube assemblies 100, pouch 200 can be sealed with seal 215 as described earlier, for example a heat seal created by a manual heat-sealing apparatus, across compartment weld 218 and sealed edges 204 and 206, between opening 210 and tear notches 222, providing a totally sealed bag. Pouch 200 can be folded over on itself at open end 210 before sealing, if desired. Packaging pouch 200 can also be reclosable or resealable, with easy-open or press-to-close seals, including zipper seals, and/or in the manner of a seal-top bag, such that opening and closing can occur repeatedly with finger pressure. Seal 215 also can be created at opening 210 instead of spaced from it.

While the above disclosure describes seals or welds 212 as defining cavities 214, in other embodiments, ribs, adhesive applied in a line to attach front side 202 to back side 201, or other structural equivalents, define cavities 214. Similarly, while the above disclosure describes one or more welds 218 as defining two or more compartments 220, 221, in other embodiments, ribs, adhesive applied in a line to attach front side 202 to back side 201, or other structural equivalents can define compartments 220, 221.

Welds 212 between cavities 214 help keep dip tubes 102 spaced in a manner that maintains dip tube straightness. The spacing between adjacent cavities 214, and adjacent dip tubes 102, inhibit tubes 102 from rubbing against each other, and dip tube assemblies 100 from rubbing against each other, which can cause undesirable particle generation.

Figure 2:
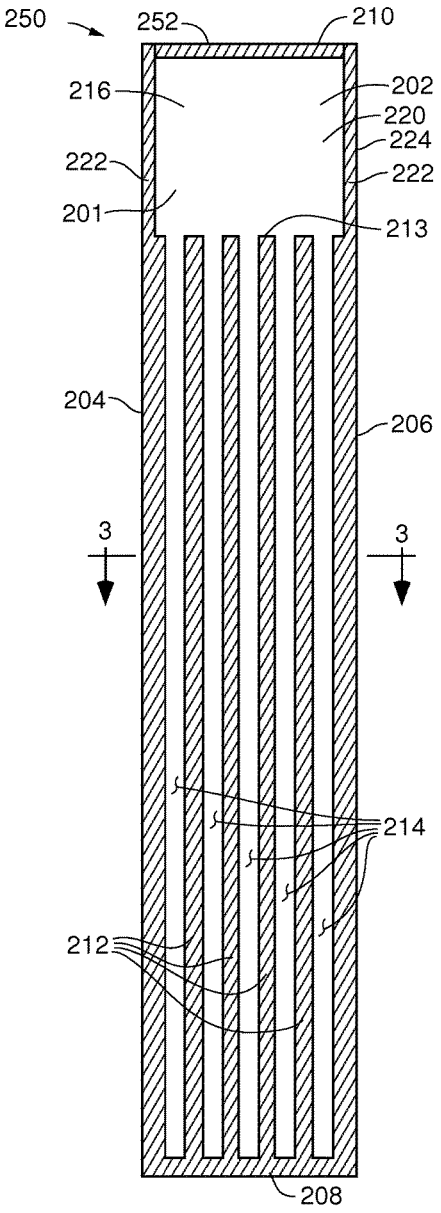
FIG. 2 is a front view of a packaging pouch according an embodiment of the disclosure.
Figure 3:
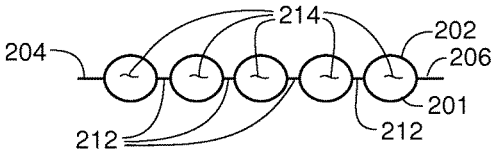
FIG. 3 is an enlarged sectional view taken along line 3-3 of FIG. 2.

Referring to FIGS. 2 and 3, packaging pouch 250 is depicted in a second embodiment of the disclosure. Packaging pouch 250 includes many of the same aspects and characteristics as packaging pouch 200, which are indicated with like reference numerals throughout all the figures. As depicted, packaging pouch 250 includes single compartment 220 having five cavities 214, as opposed to the two-compartment, ten-cavity configuration of packaging pouch 200. Packaging pouch 250, while presenting fewer cavities 214 for storage of dip tube assemblies, also presents cavities that are of longer length, if desired. In one embodiment, the volumes occupied by the packaging pouches 200 and 250 are roughly the same.

According to embodiments of the disclosure, tear-off notch 222 is included on either or both sides of packaging pouch 250 for easy opening by creating tear-off strip 224. The two optional welds defining sealed edges 204 and 206 can run the full vertical length of packaging pouch 250. After inserting dip tube assemblies 100, pouch can be sealed with a horizontal seal 252 across the sealed edges 204 and 206 at the opening 210, providing a totally sealed bag or pouch 200. Alternatively, seal 252 is provided at a different location, closer to tear notches 222, as with seal 215 of packaging pouch 200 illustrated and described with respect to FIG. 1. Other features and advantages of pouch 250 are the same as previously described with respect to other embodiments, and features and advantages of the other embodiments are equally applicable to pouch 250.

Figure 4:
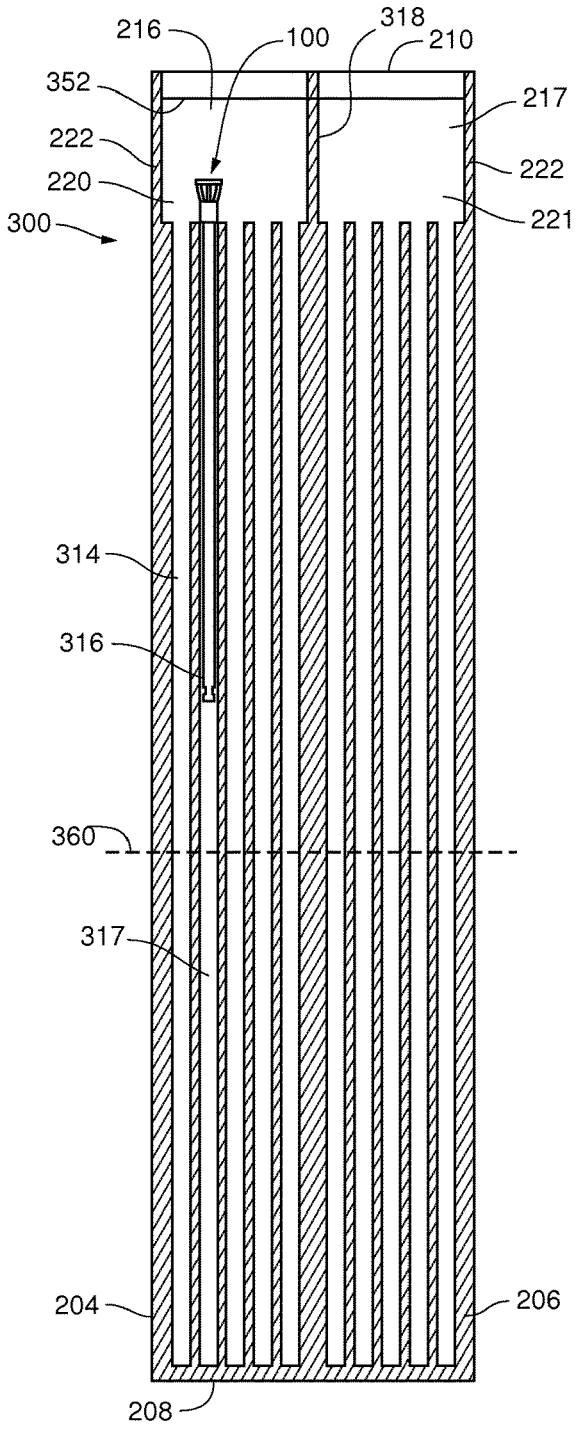
FIG. 4 is a front view of a packaging pouch according to an embodiment of the disclosure.

FIG. 4 illustrates packaging pouch 300, which is similar to pouches described previously except that compartment weld 318 extends all the way to open end or opening 210 of pouch 300. Once dip tube assemblies 100 have been loaded into packaging pouch 300, a user can apply seal 352 with less precision and thus more easily and quickly across pouch 300, because seal 352 cannot accidentally be applied between an end of compartment weld 318 and open end 210 of bag 300. Additionally, extending compartment weld 318 to open end or opening 210 of pouch 300 helps reduce the possibility of inadvertent tearing into and opening compartment 221, for example, when it is intended only to open compartment 220, for example using a tear notch 222. Additionally, pouch 300 differs from previous embodiments in that it includes substantially longer cavities 314, which are suitable for longer dip tube assemblies, such as dip tube assemblies for 200 liter dispensers. According to the illustrated embodiment, cavities 314 are over twice as long as dip tube assemblies 100. Each cavity 314 thus includes occupied portion 316, in which dip tube assembly 100 is disposed, and empty portion 317, extending from occupied portion 316 to or toward sealed end 208. After pouch 300 is loaded with dip tube assemblies 100, pouch 300 is optionally folded along fold line 360 such that package 300 is folded over onto itself such that empty portion 317 overlaps or underlaps, for example lies over or under, occupied portion 316 of each cavity 314. One or more pouches 300, folded or unfolded then are placed in secondary packaging, such as a box or carton, for shipment or storage.

Of course, it will appreciated that the compartment weld can extend all the way to open end 210 in any of the previously described embodiments, and pouches of any previously described embodiment also can be of extended length. Different sizes of dip tube assemblies 100 all can be placed in the same pouch 300, without having to manufacture custom-sized pouches for different lengths. Other features and advantages of pouch 300 are the same as previously described with respect to other embodiments, and features and advantages of the other embodiments are equally applicable to pouch 300.

Figure 5:
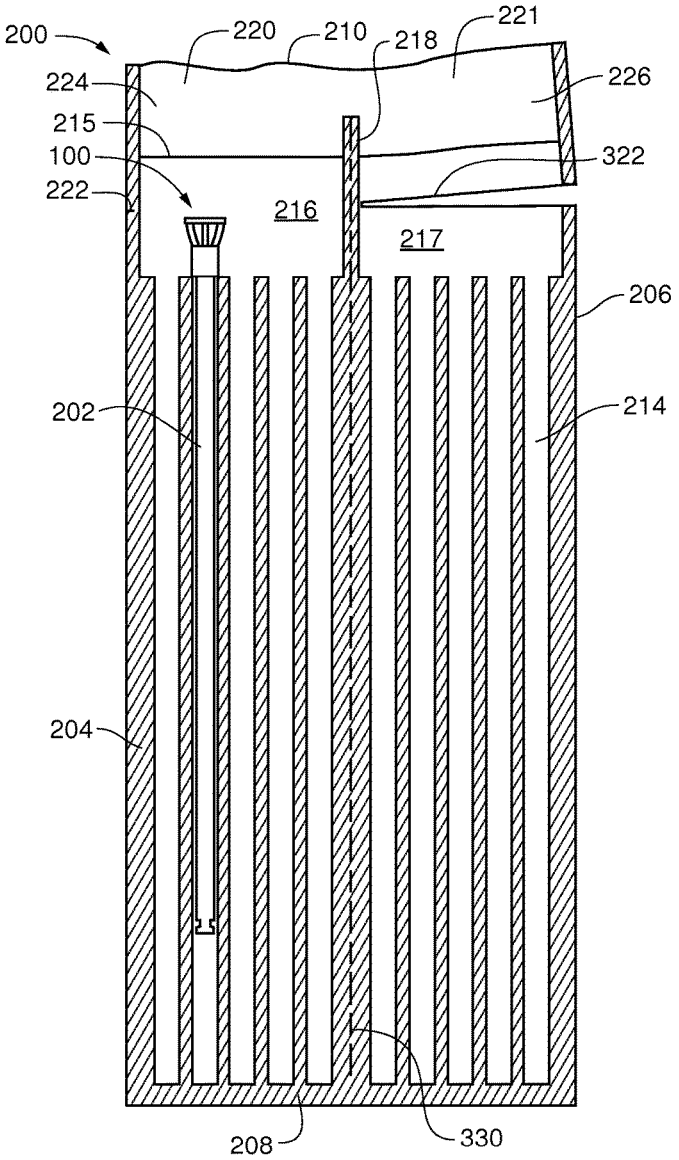
FIG. 5 is a front view of a partially opened packaging pouch according to an embodiment of the disclosure.
Figure 6:
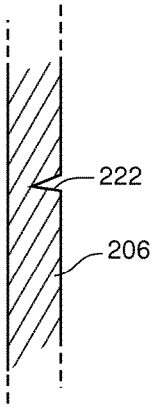
FIG. 6 is a close-up view of a tear notch, according to an embodiment of the disclosure.

FIGS. 5-6 illustrate more detail regarding the opening of pouches according to embodiments of the disclosure for the removal of dip tube assemblies therefrom. Tear notches 222 are formed in sealed edges 204 and/or 206, as previously described. To open pouch 200, as illustrated in FIG. 5, a user begins to tear pouch 200 at tear notch 222 disposed in sealed edge 206. Tear 322 is created, beginning at tear notch 22, extending generally perpendicularly to the length of pouch 200, and terminating at compartment weld 218. Tear strip 226, bordered by pouch opening 210 and tear 322, extends from sealed edge 206 to or toward compartment weld 218, opening pocket 217 of compartment 221 for exposure and removal of dip tube assemblies 100 therefrom. Tear 322 stops at compartment weld 218, and avoids seal 215, leaving pocket 216 of compartment 220 sealed and dip tube assemblies 100 therein protected from contamination originating outside pouch 200. When it is desired to remove dip tube assemblies 100 from compartment 220, a similar tear is created beginning at tear notch 222 in sealed edge 204 and extending generally perpendicularly to the length of pouch 200 over to compartment weld 218. Tear strip 224 extends from sealed edge 204 to or toward compartment weld 218, in a manner similar to tear strip 226. Perforation line 330 can be provided along compartment weld 218 for separation of sealed compartments 220, 221 from each other, such that compartment 220 can be separated from the compartment 221, with dip tube assemblies 100 still sealed within their respective compartments when compartments 220, 221 are separated from each other. Perforation line 330 is also applicable to embodiments in which compartment weld 218 extends to opening 210, as illustrated and described with respect to FIG. 4 herein, for example. In the case where multiple compartment welds 218 are provided to create more than two compartments, each compartment weld 218 can include a perforation line 330. Each compartment can include its own respective tear notch and tear strip for ready opening and accessing of the dip tube assemblies therein.

Figure 7:
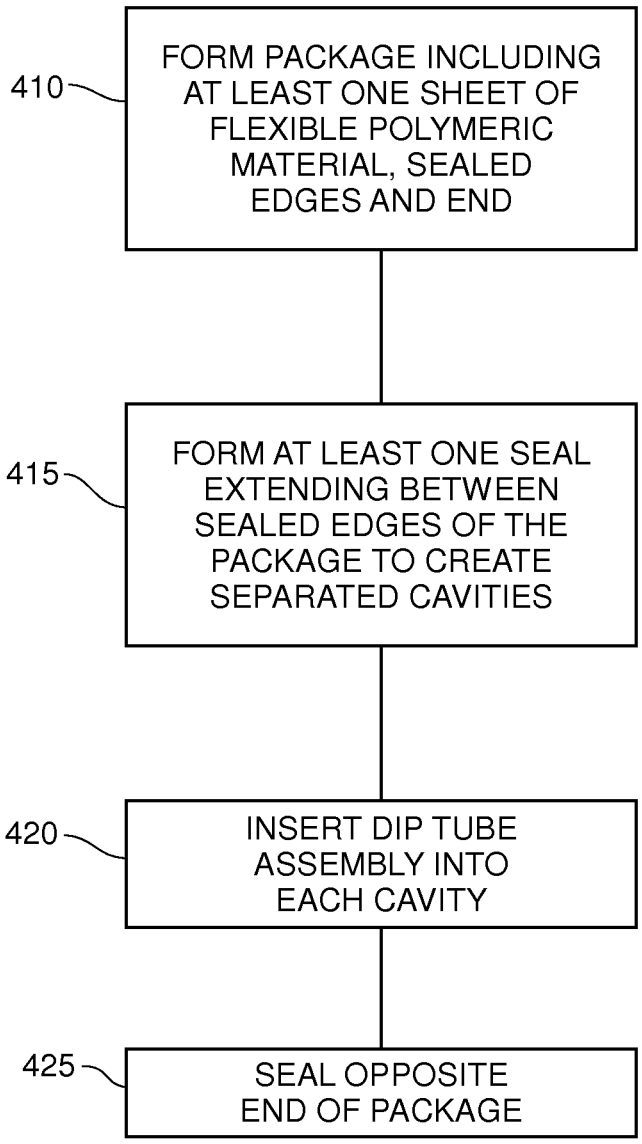
FIG. 7 is a flow chart showing a method according to an embodiment of the disclosure.

FIG. 7 illustrates a method of making a dip tube assembly packaging system, according to an embodiment of the disclosure and in connection with the previously described embodiments. The method includes creating or forming, at 410, a package including at least one sheet of flexible polymeric material having sealed edges and a first sealed end extending between the sealed edges. The method further includes creating or forming, at 415, at least one seal extending between and substantially parallel to the sealed edges to create a plurality of separated internal cavities between the sealed edges, the separated internal cavities each having a length that is less than a length of the at least one sheet. Respective dip tube assemblies are inserted into each internal cavity, at 420, each dip tube assembly including a dip tube and a coupler connected with the dip tube. The dip tube of each dip tube assembly is disposed within a respective cavity and held out of contact with adjacent dip tubes, and the coupler of each dip tube assembly extends within the package from the respective cavity and into the one or more pockets previously described. The end of the package opposite the first sealed end is itself sealed, at 425, to create a second sealed end and seal the package, such that the dip tube assemblies are sealed within the package.

Optionally, each internal cavity has an occupied portion in which a respective dip tube is disposed, and an empty portion extending from the occupied portion toward the first sealed end. The method further includes folding the package over onto itself such that the empty portion of each cavity overlaps or underlaps, for example lies over or under, the occupied portion of each cavity.

The method also optionally includes providing a compartment seal extending between and substantially parallel to the sealed edges and the at least one seal, the compartment seal dividing the package into two compartments each having a plurality of the internal cavities and a plurality of the dip tube assemblies. Embodiments of the disclosure also include forming at least one tear notch at at least one of the sealed edges of the package, to create a tear strip extending from the at least one sealed edge to the compartment seal and facilitate opening of the package for removal of the dip tube assemblies. The method also optionally includes vacuum sealing the package.

Various embodiments of dip tube assembly packaging described herein are advantageous over conventional dip tube packaging. For example, the various embodiments of dip tube assembly packaging described herein can reduce the generation of particulates and reduce damage to the dip tube assemblies during storage and/or shipping. Additionally, the various embodiments of dip tube assembly packaging described herein help generally retain the dip tube assemblies in a substantially neat, straight, and separated configuration while in storage and/or during shipping.

For purposes of illustration, the various figures herein depict zero, one, or two dip tube assemblies 100 within pouches 200, 250, 300 in the various embodiments. It should be understood, however, that any number of the internal cavities illustrated and described can have dip tube assemblies 100 disposed therein. To maximize shipping and storage efficiency, it is contemplated that every internal cavity would hold a dip tube assembly 100 before the final seal is applied at or near open end 210 to seal the package. Additionally, pouches according to embodiments of the disclosure can have any desired number of cavities within each pouch or compartment thereof, and any desired number of compartments.

Examples of some of the types of materials that may be stored, shipped, and/or dispensed using packaging or container systems according to embodiments of the disclosure include, but are not limited to: ultrapure liquids, such as acids, solvents, bases, photoresists, slurries, detergents, cleaning formulations, dopants, inorganic, organic, metalorganics, TEOS, and biological solutions, DNA and RNA solvents and reagents, pharmaceuticals, printable electronics inorganic and organic materials, lithium ion or other battery type electrolytes, nanomaterials (including for example, fullerenes, inorganic nanoparticles, sol-gels, and other ceramics), and radioactive chemicals; pesticides/fertilizers; paints/glosses/solvents/coating-materials etc.; adhesives; power washing fluids; lubricants for use in the automobile or aviation industry, for example; food products, such as but not limited to, condiments, cooking oils, and soft drinks, for example; reagents or other materials for use in the biomedical or research industry; hazardous materials used by the military, for example; polyurethanes; agrochemicals; industrial chemicals; cosmetic chemicals; petroleum and lubricants; sealants; health and oral hygiene products and toiletry products; or any other material that may be dispensed by pressure dispense, for example. In general, materials that may be used with such container systems may have any viscosity, including high viscosity and low viscosity fluids. Those skilled in the art will recognize the suitability of such container systems to various industries and for the transportation and dispense of various products, and as such, the container systems discussed herein are not limited to storing and transporting just those materials listed above. However, in some embodiments, these container systems may be particularly useful in industries relating to the manufacture of semiconductors, flat panel displays, LEDs, and solar panels; industries involving the application of adhesives and polyamides; industries utilizing photolithography technology; or any other critical material delivery application. Embodiments of the invention are also useful in life sciences applications.

In the foregoing description various embodiments have been presented for the purpose of illustration and description. They are not intended to be exhaustive or to limit the claimed disclosure to the precise form disclosed. Obvious modifications or variations are possible in light of the above teachings. The embodiments were chosen and described to provide the best illustration of the operating principles and its practical application, and to enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth they are fairly, legally, and equitably entitled.

Each of the additional figures and methods disclosed herein can be used separately, or in conjunction with other features and methods, to provide improved devices and methods for making and using the same. Therefore, combinations of features and methods disclosed herein may not be necessary to practice the disclosure in its broadest sense and are instead disclosed merely to particularly describe representative and preferred embodiments.

Various modifications to the embodiments may be apparent to one of skill in the art upon reading this disclosure. For example, the various squared-off seals or welds depicted herein can be rounded off, for example at the top and bottom of each cavity 214. As an additional example, persons of ordinary skill in the relevant art will recognize that the various features described for the different embodiments can be suitably combined, un-combined, and re-combined with other features, alone, or in different combinations. Likewise, the various features described above should all be regarded as example embodiments, rather than limitations to the scope or spirit of the disclosure.

What is claimed is:

1. A dip tube assembly packaging system, comprising:

a plurality of dip tube assemblies, each dip tube assembly comprising a tube and a coupler attached to the tube, the coupler being wider than the tube;

a package comprising at least one flexible sheet of polymeric material, the package defining sealed edges and a sealed end extending between the sealed edges, the package further comprising:

a plurality of seals defining a plurality of separated internal cavities, each cavity configured to receive the tube of a dip tube assembly in an interference fit arrangement, each cavity having a closed end and an open end opposite the closed end, the tube of each dip tube assembly being received through the open end of a respective cavity and disposed in a respective cavity in an interference fit arrangement;

at least one pocket defined at an end of the package opposite the sealed end, the open end of each of the plurality of separated internal cavities opening into the pocket, the couplers of the dip tube assemblies being disposed within the pocket in a spaced apart arrangement from one another;

wherein the sealed edges are thicker below the pocket thereby defining a shoulder;

wherein the package maintains the dip tube assemblies out of contact with each other.

2. The dip tube assembly packaging system of claim 1, wherein the package further defines a compartment divider that divides the package into two compartments and wherein the at least one pocket comprises a plurality of pockets, each compartment containing a plurality of the separated internal cavities and each compartment including a respective pocket of the plurality of pockets; wherein the tubes of a first group of the dip tube assemblies are disposed in the cavities of the first compartment and wherein the tubes of a second group of the dip tube assemblies are disposed in the cavities of the second compartment.

3. The dip tube assembly packaging system of claim 2, further comprising a seal extending across the package to seal the first compartment from the second compartment and to seal the first and second compartments from the outside of the package.

4. The dip tube assembly packaging system of claim 3, further comprising a tear notch disposed on a side of the package, the tear notch adapted to create a tear strip across the first compartment from the side of the package to the compartment divider, to open the first compartment and allow removal of the dip tube assemblies from the first compartment while the second compartment remains sealed.

5. The dip tube assembly packaging system of claim 4, wherein the tear notch is a first tear notch on a first side of the package and adapted to create a first tear strip, and the package further comprises a second tear notch disposed on a second side of the package opposite to the first side, the second tear notch adapted to create a second tear strip across the second compartment from the second side of the package to the compartment divider, to open the second compartment and allow removal of the dip tube assemblies from the second compartment.

6. The dip tube assembly packaging system of claim 1, wherein the package is at least twice as long as each dip tube assembly.

7. The dip tube assembly packaging system of claim 1, wherein the package is one-piece and formed of a single sheet of polymeric material, the plurality of separated internal cavities being defined by at least one seal extending along a length of the package.

8. The dip tube assembly packaging system of claim 1, wherein the package comprises two sheets of polymeric material sealed together along the edges and the end.

* * * * *